US005385000A

United States Patent [19]

Bakhtyari

[11] Patent Number: 5,385,000

[45] Date of Patent: Jan. 31, 1995

[54] MANUAL CONTAINER CARRIER APPLICATOR

[76] Inventor: Farshid Bakhtyari, 174 Allerton Rd., Newton, Mass. 02161

[21] Appl. No.: 106,370

[22] Filed: Aug. 13, 1993

[51] Int. Cl.[6] ..... B65B 27/04; B65B 61/14

[52] U.S. Cl. ..... 53/48.3; 53/592; 53/398

[58] Field of Search ..... 53/48.3, 48.4, 48.5, 53/390, 398, 556, 585, 592

[56] References Cited

U.S. PATENT DOCUMENTS 4,144,631 3/1979 Fujio ..... 29/446

4,208,857 6/1980 Fujio ..... 53/585

4,392,337 7/1983 Hara ..... 53/48.4

*Primary Examiner*—Horace M. Culver

*Assistant Examiner*—Rodney A. Butler

[57] ABSTRACT

A rigid body in the form of a truncated cone is dimensioned to fit over the top of a container, such as a can with a beaded top, to allow the opening in a carrier comprised of stretchable or elastic material to be manually expanded by movement of the carrier down the side of the truncated cone, beyond the bottom of the truncated cone, allowing the opening to retract against the body of the container below the beaded top.

2 Claims, 4 Drawing Sheets

MANUAL CONTAINER CARRIER APPLICATOR

BACKGROUND OF THE INVENTION

1. Field of the Invention

This invention relates to a device for assembling containers with a carrier to form a pack of containers.

2. Background and Prior Art

Containers for beer and soda are typically a cylindrical tin can with a beaded top. Often they are purchased by consumers in the form of a six-pack where the containers have been assembled into the six-pack by inserting them into the openings of a light plastic carrier. The carrier may be of the type shown in U.S. Pat. Nos. 2,874,835 or 4,121,712. Many machines have been designed for the mass production of six-packs of containers. Representative of these machines are the type shown in U.S. Pat. Nos. 3,383,828 or 3,906,704.

Local beverage distributors, grocery and convenience stores commonly purchase soda or beer containers by the case. They realize customers will want six-packs, so will often obtain the plastic carriers separately and assemble the containers into six-packs by manually inserting the containers into the openings of the carrier.

Using hands to expand the openings of the light plastic carrier for inserting the container often breaks the plastic, is time consuming, and could cause carpal tunnel injuries after prolonged activity. It is clear that the large, expensive, and complicated machinery for mass assembly would not be feasible for the small proprietors of convenience stores.

SUMMARY OF THE INVENTION

It is an object of the invention to provide a small, light weight, maintenance free, and easily portable applicator to facilitate the manual insertion of individual containers through an opening of a light plastic carrier to form a package of a plurality of the containers.

Another object of the invention is to provide an applicator for insertion of containers into the openings of a carrier which substantially reduces the risk of carpal tunnel injuries.

A further object of the invention is to provide an applicator that can be used with containers that have different diameters.

An additional object of the invention is to provide an applicator that provides a minimum amount of stretching of the light plastic carrier reducing the chance of breakage and allow for the re-use of carriers, a benefit for environmental concerns.

These and other objects, features, and advantages are achieved in a preferred embodiment of the invention comprised of a rigid device in the form of a truncated cone that can be positioned over the top of a container. The top of the cone is inserted in the opening of the plastic carrier. The carrier is slid down the cone by the fingers of the user expanding the carrier until the opening passes the bottom of the cone and bead at the top of the container, at which point the carrier retracts to grip the body of the container.

DETAILED DESCRIPTION OF PREFERRED EMBODIMENTS

Figure 1:
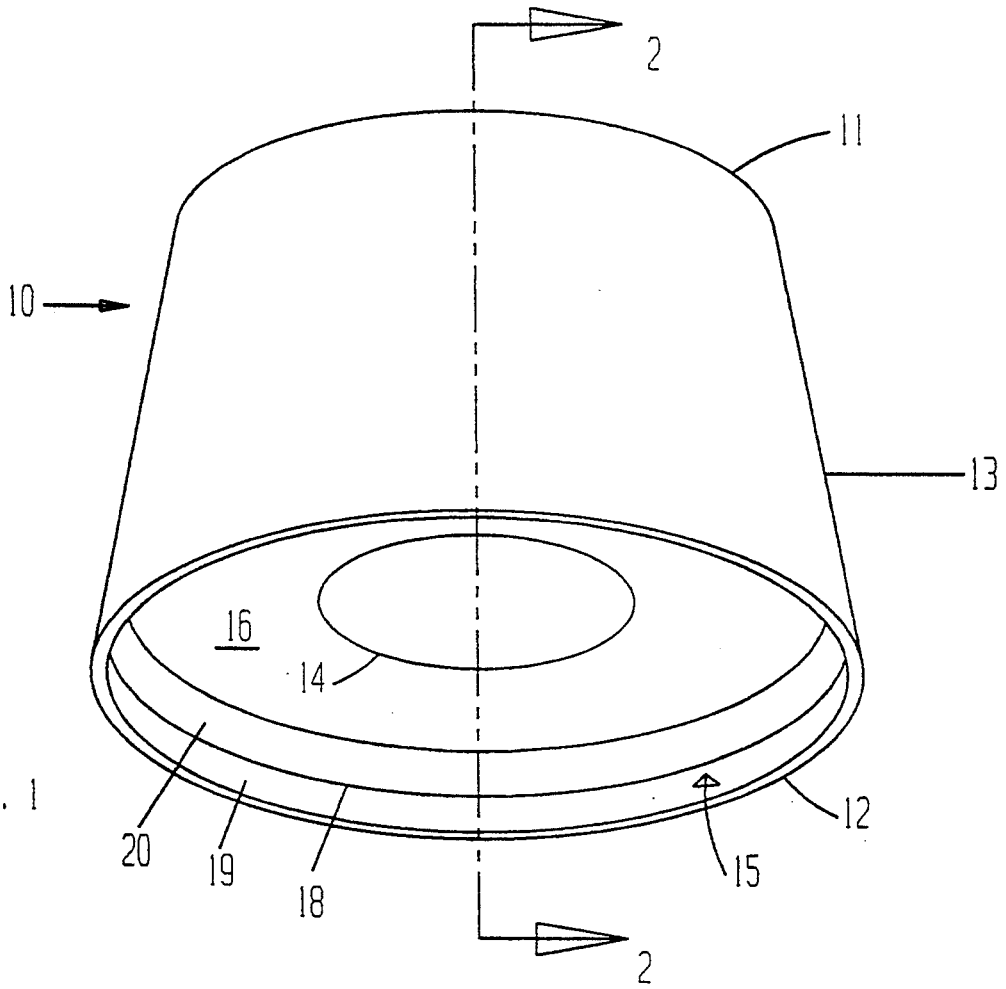
FIG. 1 is a perspective view of the preferred embodiment of the carrier applicator of the present invention.
Figure 2:
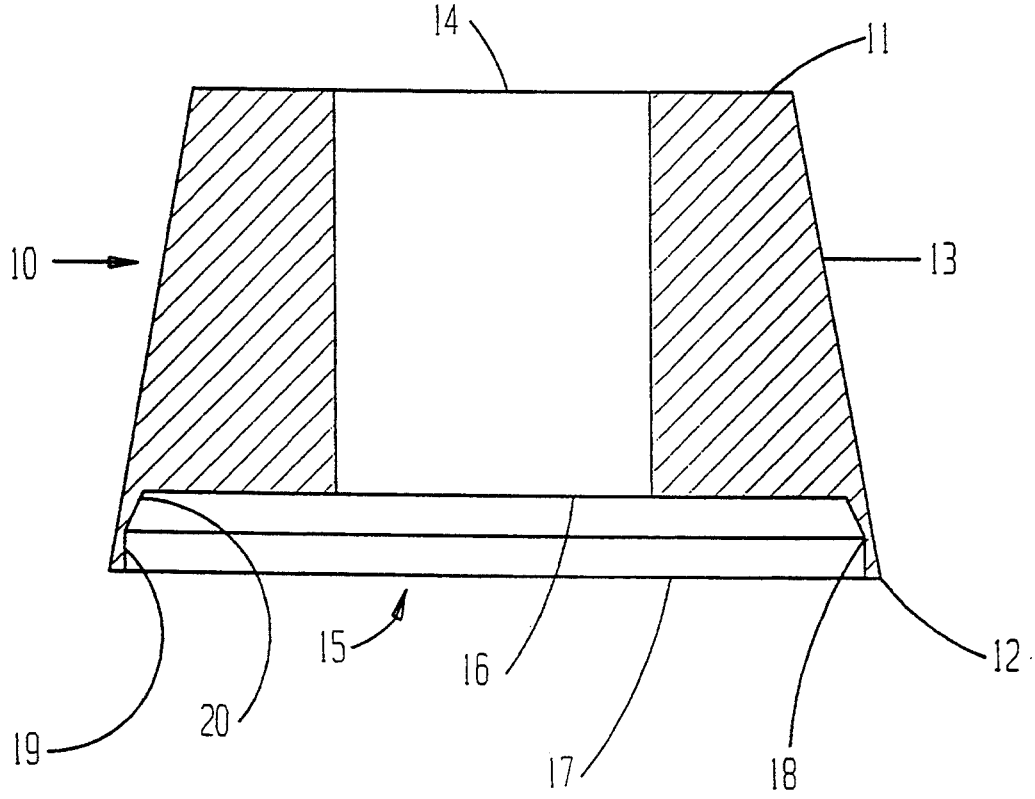
FIG. 2 is a section taken along the line 2—2 of FIG. 1.

FIGS. 1 and 2 show the major portions of the configuration of a preferred embodiment of the present invention. The applicator 10 is a rigid body having a configuration that includes a top 11, bottom 12, and side 13. The rigid body of the applicator 10 can be any suitable material providing a smooth side 13. If comprised of metal, which may make the body too heavy, a hole 14 can be drilled in the body to reduce its weight and provide a means of carrying the applicator 10.

A preferred embodiment of a positioning means for placing the applicator 10 over a container is comprised of a recess 15 in the bottom 12 of the applicator 10. The recess is comprised of a recess top 16, recess bottom 17, coplanar with the bottom 12 of the applicator 10, and a recess side 18. The recess top 16 has a diameter less than the recess bottom 17. The recess side 18 is comprised of a first side portion 19 having a diameter the same as the recess bottom 17, and a second side portion 20 that converges to the diameter of the recess top 16.

Figure 3:
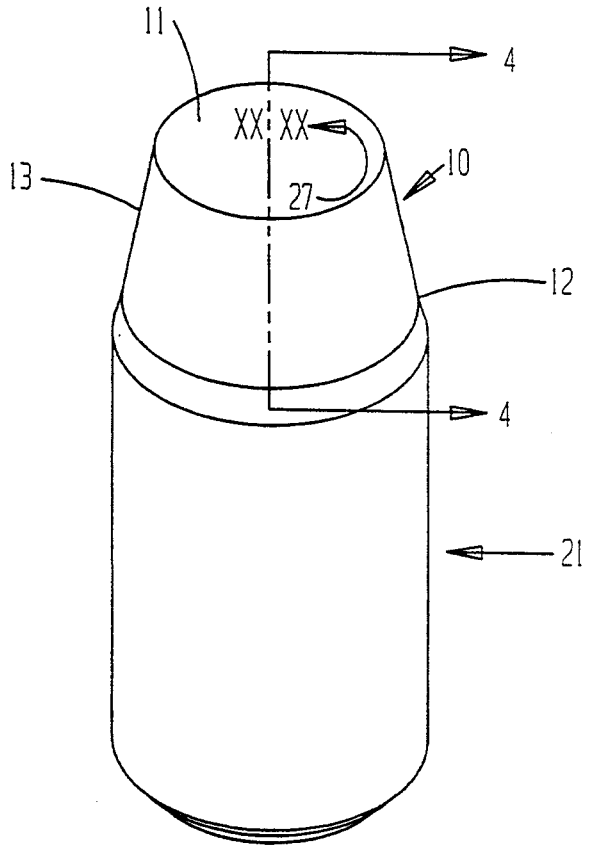
FIG. 3 is a perspective view of the applicator of the present invention placed in position on a cylindrical tin can container.
Figure 4:
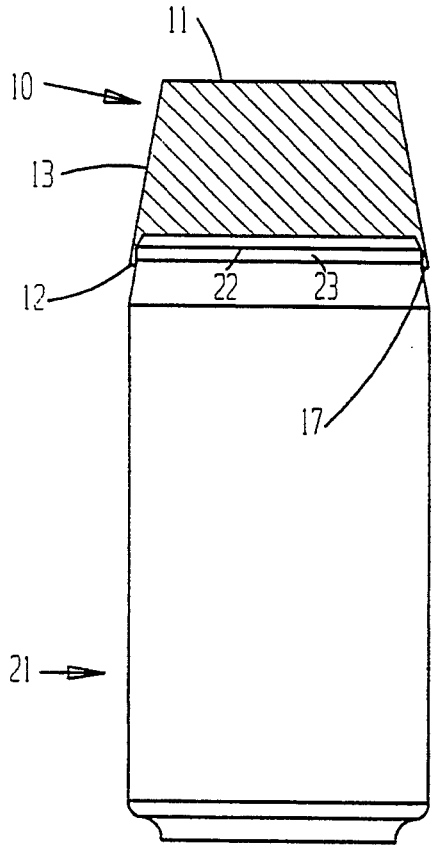
FIG. 4 is a section taken along the line 4—4 of FIG. 3.
Figure 5:
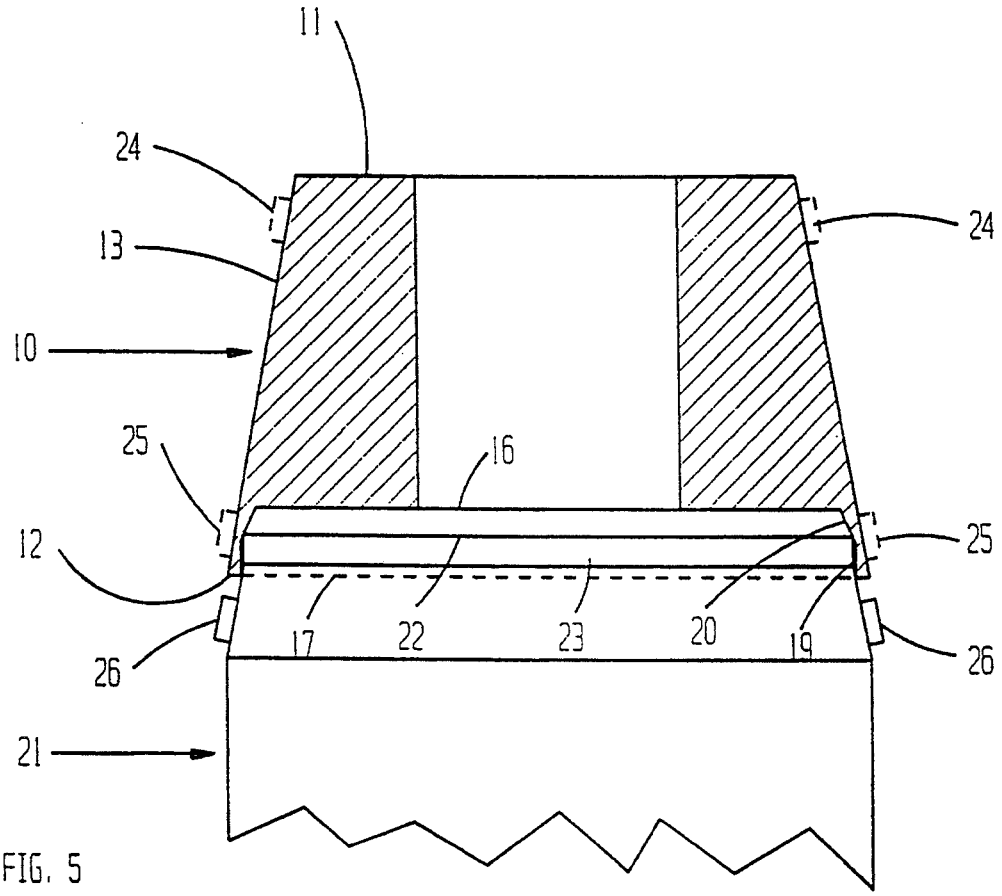
FIG. 5 shows the applicator of the present invention in position on a tin can container and the various positions of a carrier during assembly.

FIGS. 3, 4, and 5 show the applicator 10 in position on a tin can container 21. The container 21 has a top 22 that includes a bead 23. The dimensions of the container top 22 and recess bottom 17 are such that the top 22 of the container 21 fit within the recess 15 of the applicator 10. As seen in FIG. 5, the second recess side portion 20 accommodates containers with slightly different diameter tops 22.

FIG. 5 shows the theory for use of the applicator 10 with a container 21. A stretchable or elastic plastic carrier has openings for accommodating the container 21. At 24 the applicator has been inserted in an opening of the carrier. The carrier would be grasped by the thumb and fore finger of each hand of a user and slid down the side 13 of the applicator. With this motion, the carrier opening will be expanded to a point such as shown at 25. With continued downward pressure, the carrier opening will pass the bottom 12 of the applicator 10 and bead 23 of the top 22 of the container 21 until it reaches the position at 26 where the carrier opening will retract to engage the body of the container 21.

The preferred embodiment of the applicator 10 has been constructed with certain dimensions. The height of the applicator is about 1.5 inches. The diameter of the top 11 is about 1.9 inches, and the outside diameter of the bottom 12 is about 2.4 inches. This causes the side 13 to be at an angle of about 80 degrees with the bottom 12. The recess bottom 17 has an inside diameter of about 2.3 inches, and the diameter of the recess top 16 is about 2.2 inches. The depth of the recess is about $\frac{1}{4}$ inch, and the depth of the first recess side portion 19 is about $\frac{1}{8}$ inch.

Without departing from the spirit of the present invention, which facilitates the insertion of the applicator 10 through openings of a plastic carrier, the configuration of the applicator could be a complete cone. The diameters of the top 11 and bottom 12 could be equal, creating a cylinder, as long as the opening in the plastic carrier can be started over the edge of the top of the applicator. In addition, the same theory of operation of the invention can be applied to containers that are rectangular or square.

By making the top 11 of the applicator 10 planar, as shown in FIG. 3, the surface created can be used for displaying a message or logo as shown at 27.

Figure 6:
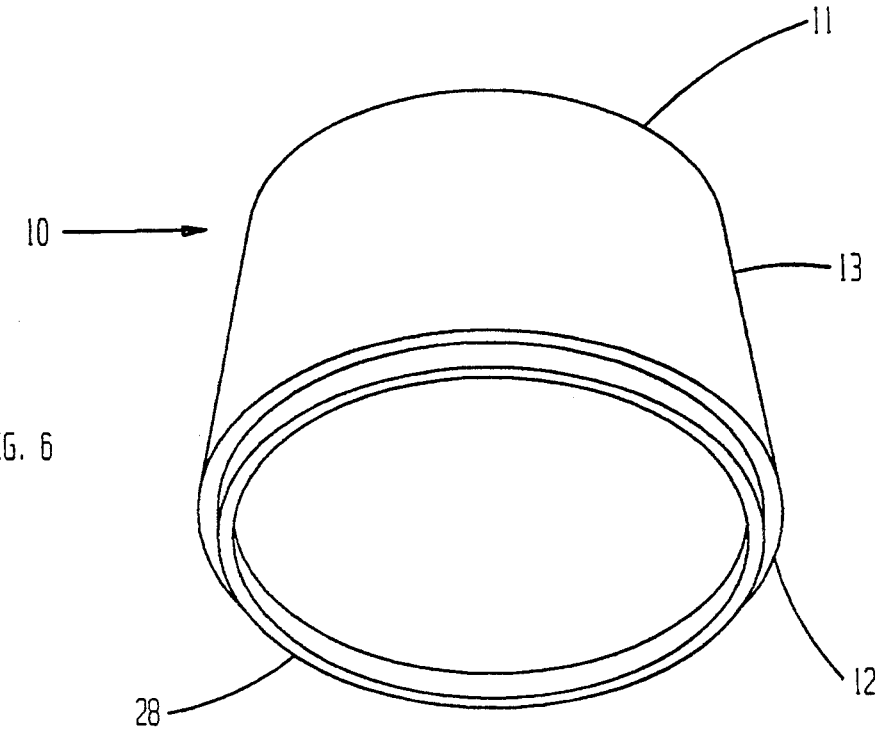
FIG. 6 is a perspective view of another embodiment of the applicator.
Figure 7:
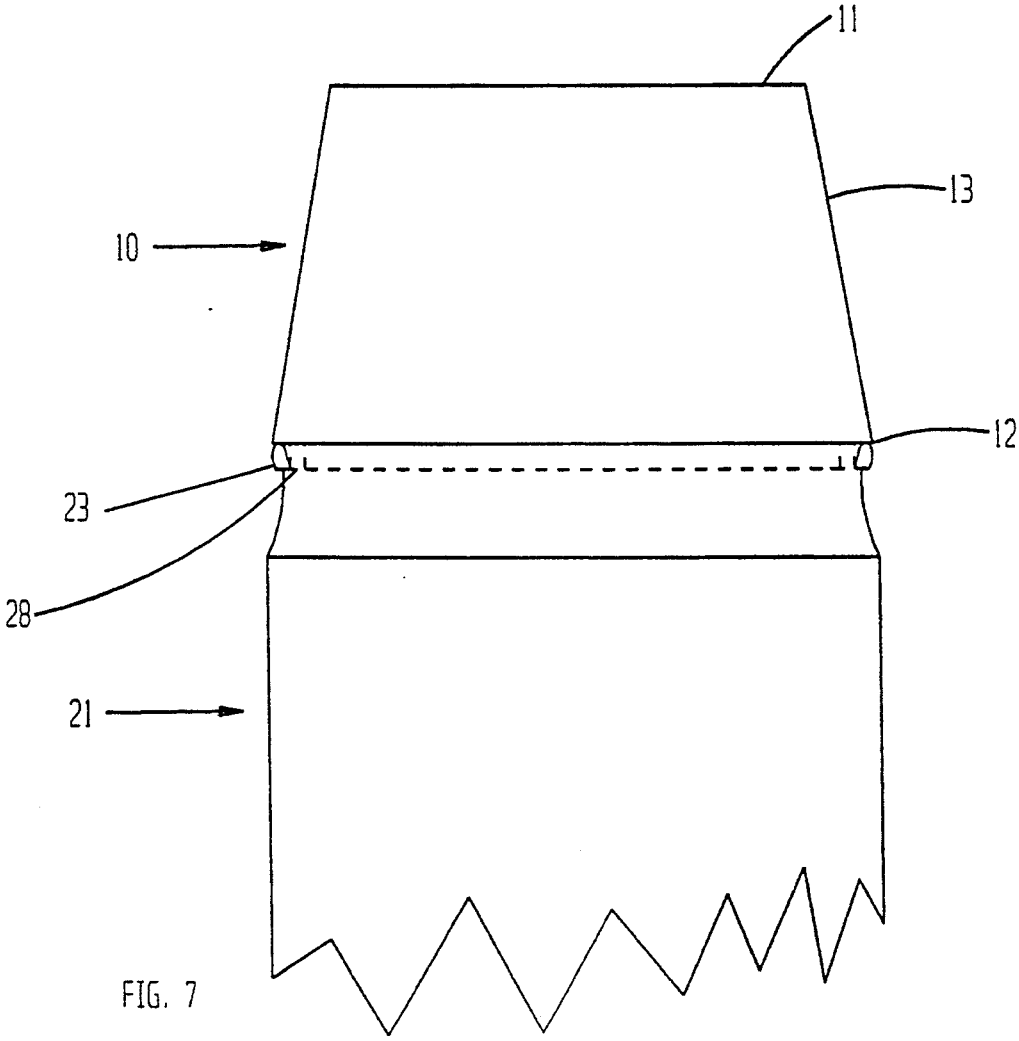
FIG. 7 shows the applicator embodiment of FIG. 6 in position on a tin can container.

FIGS. 6 and 7 show another embodiment of a means for positioning the applicator 10 over a container 21. The bottom 12 does not have a recess but rather a bottom extension in the form of a ring 28. The outside dimension of the ring 28 is less than the bottom 12 of the applicator 10, and less than the inside diameter of the top of the container 21 formed by the bead 23. If the top of the container 21 includes a tab opener, the diameter of the ring 28 will be such as to clear the end of the tab. The depth of the ring 28 is made to cause the bottom 12 of the applicator 10 to coincide with the top of the bead 23 allowing the opening of the plastic carrier to pass beyond both to retract to grasp the body of the container 21.

Figure 8:
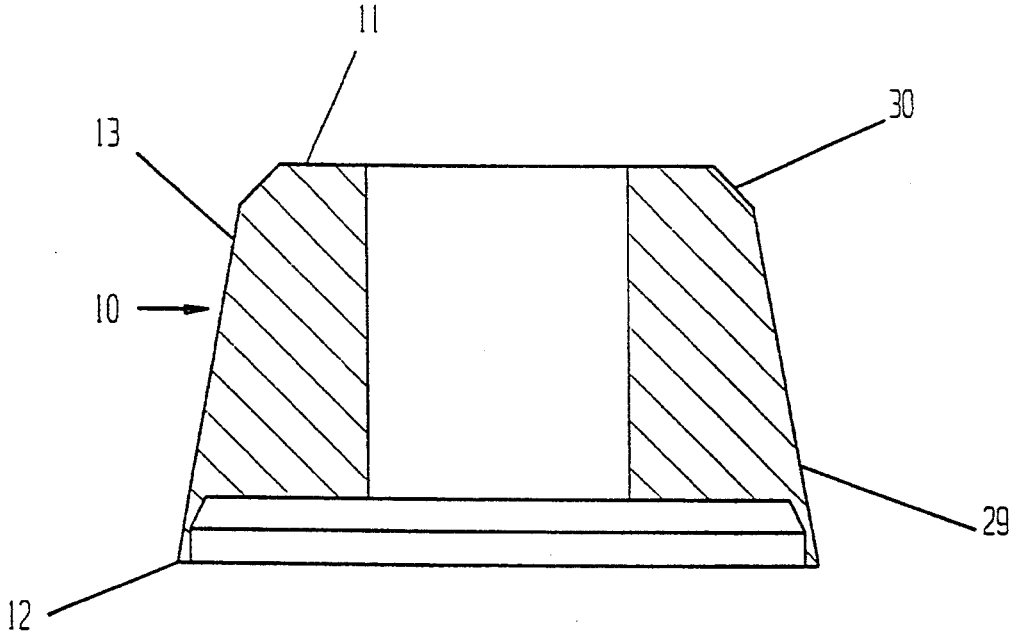
FIG. 8 shows a variation of the preferred embodiment of the present invention facilitating the start of assembly with a carrier.

FIG. 8 shows a modification of the applicator 10 to facilitate the initial insertion of the applicator through the opening in the plastic carrier. The side 13 is comprised of a first side portion 29 and a second side portion 30. The second side portion 30 has an angle relative to the bottom 12 which is less than the angle of the first side portion 29.

While I have illustrated and described the preferred embodiments of the invention, it is to be understood that I do not limit myself to the precise construction herein disclosed, and the right is reserved to all changes and modifications coming within the scope of the invention as defined in the appended claims.

Having thus described my invention, what I claim as new, and desire to secure by Letters Patent is:

1. An applicator for applying a container carrier comprised of stretchable or elastic material having at least one container accommodating opening, said applicator comprising:

a rigid body having a top, bottom, and side surface portion, said top portion having a dimension for insertion into the container accommodating opening, said bottom portion having a dimension larger than the dimension of the top of a container, and said side surface portion extends between said top and said bottom portions; and a recess in said bottom including a recess top, a recess bottom, and a recess side, said recess bottom having a dimension to enclose the top of a container within said recess, said recess top having a dimension less than said recess bottom, and said recess side includes a first recess side portion having a dimension equal to the dimension of said recess bottom, and a second recess side portion converging to the dimension of said recess top.

2. An applicator in accordance with claim 1 wherein:

said rigid body is a truncated cone whereby said top portion is inserted in the at least one container accommodating opening without stretching the carrier material, and said bottom portion dimension expands the carrier material to cause the carrier opening to pass over the top of the container and retract to enclose the body of the container.

* * * * *